United States Patent [19]

Igarashi

[11] Patent Number: 4,593,669

[45] Date of Patent: Jun. 10, 1986

[54] INJECTION TIMING CONTROL DEVICE FOR DISTRIBUTOR-TYPE FUEL INJECTION PUMPS

[75] Inventor: Shinichi Igarashi, Higashimatsuyama, Japan

[73] Assignee: Diesel Kiki Co., Ltd., Tokyo, Japan

[21] Appl. No.: 729,693

[22] Filed: May 2, 1985

[30] Foreign Application Priority Data

May 8, 1984 [JP] Japan ..... 59-91589

[51] Int. Cl.[4] ..... F02M 39/00

[52] U.S. Cl. ..... 123/502; 123/449; 100/285

[58] Field of Search ..... 60/285, 274; 123/502, 123/449, 500, 501

[56] References Cited

U.S. PATENT DOCUMENTS 4,452,040 6/1984 Kobashi ..... 60/285
4,478,195 10/1984 Dorenkamp ..... 123/502

FOREIGN PATENT DOCUMENTS 0138427 10/1981 Japan ..... 123/502
0217729 12/1983 Japan ..... 123/502
2047922 12/1980 United Kingdom ..... 123/502

*Primary Examiner*—Carl Stuart Miller
*Attorney, Agent, or Firm*—Frishauf, Holtz, Goodman & Woodward

[57] ABSTRACT

An injection timing control device in a distributor-type fuel injection pump for an internal combustion engine having a filter arranged in the exhaust passage for trapping exhaust gas fine particles, and a sensor for detecting exhaust pressure upstream of the filter. A timer spring and a second spring having a smaller force than that of the timer spring are accommodated within a spring chamber at one end of a timer piston. While the timer piston is displaced from its initial position to a predetermined position in the injection timing advancing direction by pressure within a hydraulic pressure chamber at the other end of the timer piston, the second spring alone counteracts the displacement of the timer piston. When the timer piston is further displaced beyond the predetermined position in the injection timing advancing direction, at least the timer spring counteracts the displacement of the timer piston. A communication passage communicates the hydraulic pressure chamber with the spring chamber, which passage is selectively opened or closed by an electromagnetic valve in response to the exhaust pressure value detected by the sensor.

1 Claim, 3 Drawing Figures

INJECTION TIMING CONTROL DEVICE FOR DISTRIBUTOR-TYPE FUEL INJECTION PUMPS

BACKGROUND OF THE INVENTION

This invention relates to an injection timing control device for distributor-type fuel injection pumps, and more particularly to an injection timing control device which is applied to an internal combustion engine of the type adapted to burn up noxious particles contained in the exhaust gases.

An internal combustion engine, a diesel engine in particular, is generally provided with a filter in its exhaust system, to trap or collect noxious fine particles in the exhaust gases for purging the exhaust gases from the engine. The particles trapped in the filter are burnt up so as to regenerate the filter.

One of such devices for burning up the exhaust gas particles has been proposed by Japanese Utility Model Provisional Publication No. 58-108222, which comprises a filter arranged in the exhaust passage of the engine for trapping fine particles in the exhaust gases, a burner composed of a fuel injection nozzle, a heater and an ignition plug arranged in the exhaust passage at a location upstream of the filter for burning up the exhaust gas particles, and an exclusive fuel tank and an exclusive pressure pump connected to the fuel injection nozzle. However, this proposed device thus has a large number of component parts and is therefore heavy in weight as well as high in the manufacturing cost.

SUMMARY OF THE INVENTION

It is an object of the invention to provide an injection timing control device for distributor-type fuel injection pumps, which is provided with means of a simple structure capable of burning up the exhaust gas particles trapped in the filter, to thereby dispense with the use of a burner composed of a fuel injection nozzle, a heater, an ignition plug, etc. in the exhaust system of the engine.

It is another object of the invention to provide an injection timing control device for distributor-type fuel injection pumps, which is easily switchable between an operative state for burning up the exhaust gas particles and a normal operative state for controlling the fuel injection timing of the fuel injection pump in an ordinary or conventional manner, to thereby satisfy injection timing characteristics required by the engine over its whole operating region.

The invention provides an injection timing control device for combination with a fuel injection pump for an internal combustion engine having an exhaust passage, filter means arranged in the exhaust passage for trapping fine particles contained in exhaust gases from the engine, and a sensor for detecting exhaust pressure of the engine at a zone upstream of the filter means. The injection timing control means comprises: a cylinder; a timer piston slidably received within the cylinder, displacement of which provides a corresponding change in the fuel injection timing of the fuel injection pump; a hydraulic pressure chamber defined between the cylinder and one end face of the timer piston, which is supplied with a hydraulic pressure variable as a function of the rotational speed of the engine to urge the timer piston in a direction of advancing the fuel injection timing; a spring chamber defined between the cylinder and another opposite end face of the timer piston, which communicates with a zone under lower pressure; a first spring accommodated within the spring chamber and urging the timer pistion in a direction of retarding the fuel injection timing against the pressure in the hydraulic pressure chamber; a second spring accommodated within the spring chamber and urging the timer pistion in the injection timing retarding direction against the pressure in the hydraulic pressure chamber, the second spring having a force smaller than that of the first spring; spring selecting means for selectively allowing the first and second springs to operate, in a manner such that while the timer piston is displaced from an initial position thereof to a predetermined position in the injection timing advancing direction, the second spring alone exerts a force thereof to counteract the displacement of the timer piston, whereas when the timer piston is further displaced beyond the predetermined position in the injection timing advancing direction, at least the first spring exerts a force thereof to counteract the displacement of the timer piston; a communication passage communicating the hydraulic pressure chamber with the spring chamber; an electromagnetic valve having a solenoid and a spool valve body arranged across the communication passage, the electromagnetic valve having the solenoid deenergized or energized to selectively assume a first position where the valve body closes the communication passage to disconnect the hydraulic pressure chamber from the spring chamber, or a second position where the valve body opens the communication passage to communicate the hydraulic pressure chamber with the spring chamber; and control means for energizing and deenergizing the solenoid of the electromagnetic valve, the control means being adapted to cause the electromagnetic valve to assume the first position when the exhaust pressure value detected by the sensor is smaller than a predetermined value, and to assume the second position when the detected exhaust pressure value is larger than the predetermined value.

The above and other objects, features and advantages of the invention will be more apparent from the ensuing detailed description taken in conjunction with the accompanying drawings.

DETAILED DESCRIPTION

Figure 1:
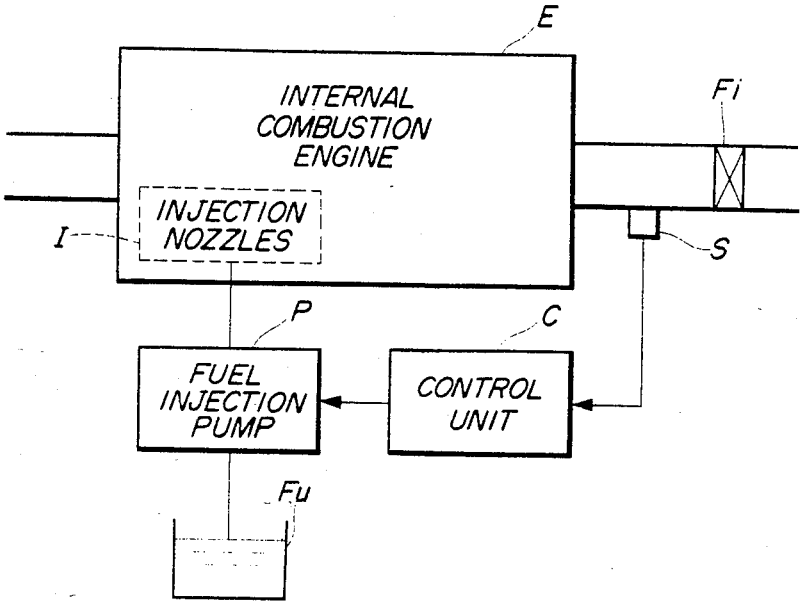
FIG. 1 is a block diagram schematically illustrating a distributor-type fuel injection pump to which the invention is applied, and an internal combustion engine associated therewith.

Referring first to FIG. 1, there are schematically illustrated a distributor-type fuel injection pump P to which the invention is applied, and an internal combustion engine E operatively connected with the pump P. Connected to the fuel injection pump P are a fuel tank Fu as well as fuel injection nozzles I mounted in cylinders, not shown, of the engine E. A filter Fi is arranged in the exhaust passage of the engine E for trapping or collecting noxious fine particles contained in the exhaust gases. A sensor S is mounted in the exhaust passage to detect exhaust pressure upstream of the filter Fi, and is electrically connected to a control unit C. The control unit C is electrically connected to an electromagnetic valve 24 appearing in FIG. 2, to supply same with a driving signal dependent upon the detected exhaust pressure value from the sensor S, as hereinafter described in detail.

Figure 2:
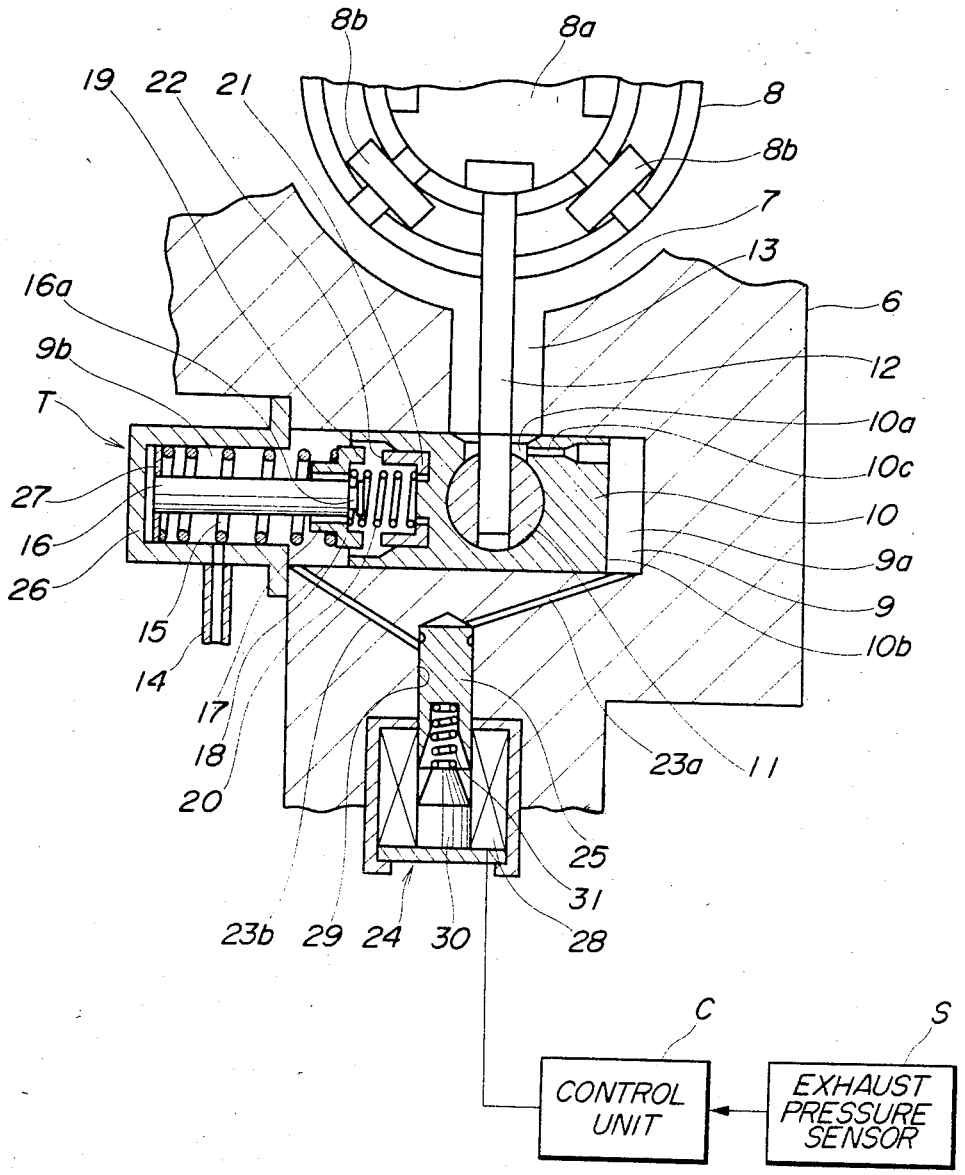
FIG. 2 is a longitudinal sectional view of an injection timing control device applied to the distributor-type fuel injection pump in FIG. 1, according to an embodiment of the invention.

Referring next to FIG. 2, there are illustrated an injection timing control device coupled to the fuel injection pump P in FIG. 1, and its peripheral parts. In the figure, a pump housing 6 has defined therein a suction space 7 filled with pressurized fuel under pressure proportional to the rotational speed of the engine E in FIG. 1. Mounted within the suction space 7 is a roller holder 8 displaceable in circumferential position, which has a central axial hole 8*a* in which is arranged coupling means connecting between a drive shaft of the pump and a plunger of same, none of which are shown. The roller holder 8 carries a plurality of rollers 8*b* circumferentially arranged around the central axial hole 8*a* at equal intervals, and disposed in rolling contact with the cam surface of a cam disc, not shown, secured to an end of the plunger. The plunger rotates in unison with the drive shaft while simultaneously axially reciprocating, as the rollers 8*b* of the roller holder 8 roll over the cam surface of the cam disc, to distribute fuel to the fuel injection nozzles I in FIG. 1.

An injection timing control device T is provided at the bottom of the pump housing 6. A cylinder 9 is formed in the pump housing 6, within which is slidably received a timer piston 10. A rotary coupling 11 is mounted in the timer piston 10 at an axially central portion thereof for rotation about an axis perpendicular to the axis of the timer piston 10. Secured to the coupling 11 is one end of a connecting rod 12 which extends through a hole 13 formed in the pump housing 6 and a cavity 10*a* formed in the timer piston 10 and is coupled at the other end to the roller holder 8. Therefore, axial displacement of the timer piston 10 causes corresponding circumferential displacement of the roller holder 8, i.e. the rollers 8*b*, thereby varying the timing of the fuel injection.

Defined between an end face 10*b* of the timer piston 10 and an opposed end face of the cylinder 9 is a hydraulic pressure chamber 9*a* which is supplied with pressurized fuel under pressure proportional to the rotational speed of the engine E, from the suction space 7 via the hole 13, the cavity 10*a* and an orifice 10*c* formed in the timer piston 10.

On the other hand, a timer spring chamber 9*b* is defined between the other end face of the timer piston 10, the cylinder 9, and the interior of a covering member 26 secured to the pump housing 6, and communicates with the interior of the fuel tank Fu in FIG. 1 under a lower pressure, through a pipe 14 connected to the covering member 26.

A timer spring 15 is accommodated within the timer spring chamber 9*b* and disposed around a rod 16 having one end secured to the inner peripheral surface of the covering member 26 via an annular member 27 rigidly fitted on the rod 16. To be specific, the timer spring 15 is supported at one end by the annular member 27 and at the other end by a spring seating portion 18 of a slider 17 slidably fitted on the other end portion of the rod 16, to apply its force to the slider 17 in a direction toward the timer piston 10. A ring stopper 19 is fitted in an annular groove 16*a* formed in the other end of the rod 16 close to the timer piston 10, to limit a rightward extreme position of the slider 17 which is urged toward the timer piston 10 by the force of the timer spring 15.

When it is not necessary to burn up the exhaust gas particles trapped in the filter Fi, the timer spring 15 is allowed to apply its force to the timer piston 10 in a rightward direction as viewed in FIG. 2, i.e. in a direction of retarding the fuel injection timing, with its other end abutted against the timer piston 10 via the slider 17, as hereinafter described in detail.

A retarding spring 20 is interposed between the timer spring 15 and the timer piston 10. That is, the spring 20 has one end supported by a spring seat 21 provided at the other end of the timer piston 10, and the other end supported by the ring stopper 19. The retarding spring 20 has its force set at a value smaller than that of the timer spring 15, so that only when the engine E is stopped or when it is necessary to burn up the exhaust gas particles in the filter Fi, the spring 20 is allowed to urgingly displace the timer piston 10 in the injection timing retarding direction, by means of the electromagnetic valve 24, hereinafter referred to. On the other hand, when it is not necessary to burn up the exhaust gas particles during operation of the engine E, the retarding spring 20 is compressed by high pressure within the hydraulic pressure chamber 9*a*, to bring the spring seating portion 18 of the slider 17 into contact with an end face 22 of the spring seat 21 facing the timer spring 15, whereby the retarding spring 20 is rendered substantially ineffective in the injection timing control.

Communication passages 23*a* and 23*b* are formed in the pump housing 6 to communicate the hydraulic pressure chamber 9*a* with the timer spring chamber 9*b*. The electromagnetic valve 24 is interposed between the communication passages 23*a* and 23*b* to selectively establish and block the communication between these passages 23*a*, 23*b*. To be specific, the electromagnetic valve 24 comprises a valve chamber 29 interposed between the communication passages 23*a* and 23*b*, a solenoid 28 electrically connected to the control unit C, a spool valve body 25 slidably received within the valve chamber 29, a stator core 30, and a spring 31 interposed between the valve body 25 and the stator core 30 and urging the valve body 25 toward its closed position. When the solenoid 28 is deenergized, the valve body 25 is biased by the urging force of the spring 31 to a first or closed position as illustrated, where the hydraulic pressure chamber 9*a* is disconnected from the timer spring chamber 9*b*, whereas when the solenoid 28 is energized, the valve body 25 is displaced toward the stator core 30 or downward as viewed in FIG. 2, against the force of the spring 31 to assume a second or open position where the hydraulic pressure chamber 9*a* and the timer spring chamber 9*b* are communicated with each other.

The control unit C is adapted to energize the solenoid 28 of the electromagnetic valve 24 so as to open its valve body 25 when the exhaust pressure sensed by the sensor S becomes higher than a predetermined set value due to an increase in the amount of the exhaust gas particles trapped in the filter Fi (FIG. 1).

Figure 3:
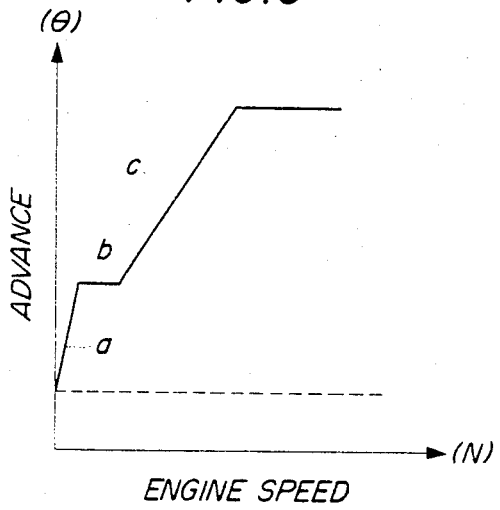
FIG. 3 is a graph showing injection timing advancing and retarding characteristics obtained by the device of FIG. 2.

The operation of the injection timing control device T of the fuel injection pump, constructed as above, will now be described by referring to FIGS. 2 and 3.

When the engine E is at rest, the injection timing control device T is in the illustrated position, with the electromagnetic valve 24 in the illustrated closed position. Then, as the engine E is started, increased fuel pressure in the suction space 7 is supplied to the hydraulic pressure chamber 9*a* via the hole 13, the cavity 10*a* and the orifice 10*c*, to cause the timer piston 10 to move leftward from an initial position as illustrated while causing compression of the retarding spring 20 (a in FIG. 3), and then to abut against the spring seating portion 18 of the slider 17 via the spring seat 21 (b in FIG. 3). The retarding spring 20 has such a setting force that even a slight increase in the fuel pressure within the suction space 7 upon starting of the engine causes the spring 20 to be instantly compressed by corresponding displacement of the timer piston 10 to thereby bring the spring seat 21 into contact with the slider 17.

After the timer piston 10 has thus got into contact with the slider 17 via the spring seat 21 (b in FIG. 3), the retarding spring 20 no longer substantially contributes to the injection timing control. That is, on this occasion, the axial position of the timer piston 10 is determined by the fuel pressure within the hydraulic pressure chamber 9*a* and the counteracting force of the timer spring 15, to thereby determine the circumferential position of the roller holder 8 through the connecting rod 12. A change in the circumferential position of the roller holder 8 causes a corresponding change in the axial operative position of the plunger relative to the angular phase of the drive shaft, which in turn causes a corresponding change in the fuel injection timing. For instance, when the rotational speed of the engine E increases, increased fuel pressure within the hydraulic pressure chamber 9*a* surpasses the force of the timer spring 15, to cause leftward displacement of the timer piston 10 as viewed in FIG. 2 (c in FIG. 3), and accordingly displacement of the roller holder 8 in the clockwise direction to advance the fuel injection timing. Thus, while the electromagnetic valve 24 is in the first or closed position, the injection timing control device T provides an ordinary injection timing advancing characteristic as shown by the solid line in FIG. 3.

On the other hand, when the detected value of the exhaust pressure sensor S exceeds the predetermined set value with an increase in the amount of the exhaust gas particles trapped in the filter Fi, during operation of the engine E, the control unit C energizes the solenoid 28 of the electromagnetic valve 24 so that the valve body 25 is displaced downward from the illustrated position to the second or open position to communicate the hydraulic pressure chamber 9*a* with the timer spring chamber 9*b*, thereby lowering the pressure within the hydraulic pressure chamber 9*a* to a level equal to that within the timer spring chamber 9*b*, i.e. to a level substantially equal to the atmospheric pressure. Accordingly, the timer piston 10 is returned rightward as viewed in FIG. 2, by the urging force of the timer spring 15, and then further displaced by the urging force of the retarding spring 20 then expanding, to a position represented by the broken line in FIG. 3, to provide more retarded injection timing than that obtained (b in FIG. 3) during normal operation of the engine. As a result, the combustion temperature within the engine cylinders increases to increase the temperature of the exhaust gas, whereby the fine particles trapped in the filter Fi are burned up by the hot gases passing the exhaust passage.

Thus, according to the invention, the exhaust gas particles in the filter Fi can be burned up at any speed at which the engine is operated, by merely opening the electromagnetic valve 24 to thereby promptly bring the timer piston 10 to a greater retarded position. Besides, by closing again the electromagnetic valve 24, the injection timing control device T can promptly resume a normal position to provide an ordinary injection timing characteristic in which the retarding spring 20 does not substantially contribute to the injection timing control.

Although in the illustrated embodiment the electromagnetic valve 24 is adapted to close at deenergization of the solenoid 28 and to open at energization of same, it may alternatively be adapted to close and open at energization and deenergization of the solenoid 28, respectively.

While a preferred embodiment of the invention has been described, variations thereto will occur to those skilled in the art within the scope of the present inventive concepts which are delineated by the following claims.

what is claimed is:

1. An injection timing control device for combination with a fuel injection pump for an internal combustion engine having an exhaust passage, filter means arranged in said exhaust passage for trapping fine particles contained in exhaust gases from said engine, and a sensor for detecting exhaust pressure of said engine at a zone upstream of said filter means, said device comprising:

a housing having a cylinder;

a timer piston slidably received within said cylinder;

connecting means for translating displacement of said timer piston into a corresponding change in the fuel injection timing of said fuel injection pump;

said housing defining a hydraulic pressure chamber between said cylinder and one end face of said timer piston, and means for communicating to said hydraulic chamber a hydraulic pressure variable as a function of the rotational speed of said engine to urge said timer piston in a direction of advancing the fuel injection timing;

said housing defining a spring chamber between said cylinder and an opposite end face of said timer piston, and means for communicating said spring chamber with a relatively low pressure zone;

a first spring accommodated within said spring chamber for urging said timer piston in a direction of retarding the fuel injection timing to a most retarded normal operating position, against the pressure in said hydraulic pressure chamber;

a second spring accommodated within said spring chamber and urging said timer piston in said injection timing retarding direction against the pressure in said hydraulic pressure chamber, said second spring having a force smaller than that of said first spring;

spring selecting means for selectively allowing said first and said second springs to operate, in a manner such that while said timer piston is displaced from an initial position thereof to a predetermined position in said injection timing advancing direction, said second spring alone exerts a force thereof to counteract the displacement of said timer piston, and when said timer piston is further displaced beyond said predetermined position in said injection timing advancing direction, at least said first spring exerts a force thereof to counteract the displacement of said timer piston;

said housing defining a communication passage communicating said hydraulic pressure chamber with said spring chamber;

an electromagnetic valve having a solenoid and a spool valve body arranged within said communication passage, said electromagnetic valve having said solenoid selectively deenergized or energized to assume a first position where said valve body closes said communication passage to disconnect said hydraulic pressure chamber from said spring chamber, or a second position where said valve body opens said communication passage to communicate said hydraulic pressure chamber with said spring chamber; and control means for energizing and deenergizing said solenoid of said electromagnetic valve, said control means being adapted to cause said electromagnetic valve to assume said first position when the exhaust pressure value detected by said sensor is smaller than a predetermined value, and to assume said second position when the detected exhaust pressure value is larger than said predetermined value;

wherein said spring selecting means comprises a rod accommodated within said spring chamber, said rod having one fixed end remote from said timer piston and another end close to said timer piston, a spring seat member slidably fitted on said rod at said another end thereof, and stopper means provided on said rod at said another end thereof for limiting an extreme position of said spring seat member toward said timer piston, said first spring being interposed between said spring seat member and an opposed end face of said cylinder, said second spring being interposed between said opposite end face of said timer piston and said stopper, wherein the smaller force of said second spring is such that during normal operation of said engine, said second spring is compressed by said timer piston as displaced by pressure in said hydraulic pressure chamber so that said timer piston contacts said spring seat member, when said electromagnetic valve is at said first position; and said second spring expands to displace said timer piston away from said spring seat member to a more retarded position than said most retarded normal operating position assumable during normal engine operation, when said electromagnetic valve is at said second position.

* * * * *